US006631953B2

(12) United States Patent
Lai

(10) Patent No.: US 6,631,953 B2
(45) Date of Patent: Oct. 14, 2003

(54) BACKREST ELEVATOR DEVICE

(76) Inventor: Yu-Shan Lai, 4F-3, No. 228, Tzu Yu Rd., Jia Yi City (TW)

( * ) Notice: Subject to any disclaimer, the term of this patent is extended or adjusted under 35 U.S.C. 154(b) by 22 days.

(21) Appl. No.: 09/962,036

(22) Filed: Sep. 25, 2001

(65) Prior Publication Data

US 2003/0057756 A1 Mar. 27, 2003

(51) Int. Cl.[7] ..... B60N 2/02
(52) U.S. Cl. ..... 297/353
(58) Field of Search ..... 297/353, 411.36; 403/107, 108, 109

(56) References Cited

U.S. PATENT DOCUMENTS 5,588,766 A * 12/1996 Lai ..... 248/297.31
5,649,741 A * 7/1997 Beggs ..... 297/353
6,264,276 B1 * 7/2001 Chen ..... 297/353 X
6,299,253 B1 * 10/2001 Chen ..... 297/353 X

* cited by examiner

*Primary Examiner*—Anthony D. Barfield
(74) *Attorney, Agent, or Firm*—Alan D. Kamrath; Rider Bennett, LLP.

(57) ABSTRACT

A backrest elevator device has a main plate, an adjustment panel, a driven block, a spring, and a cover plate. The main plate has a hollow interior, a corrugated slot, and a plurality of serrations. The adjustment panel has a chamber and a guide groove communicating with the chamber. The driven block has a protruded block. The driven block is inserted in the chamber. The spring is disposed between the adjustment panel and the driven block. The cover plate is disposed on the adjustment panel to cover the chamber. The adjustment panel engages with the main plate. The protruded block engages with two of the serrations.

1 Claim, 9 Drawing Sheets

BACKREST ELEVATOR DEVICE

BACKGROUND OF THE INVENTION

The present invention relates to a backrest elevator device. More particularly, the present invention relates to a backrest elevator device which elevates a backrest of a chair easily.

A conventional backrest elevator device has a complex structure. It is difficult for a user to operate the conventional backrest elevator device.

SUMMARY OF THE INVENTION

An object of the present invention is to provide a backrest elevator device which has a simple structure to elevate a backrest of a chair easily.

Accordingly, a backrest elevator device comprises a main plate, an adjustment panel, a driven block, a spring, and a cover plate. The main plate has a corrugated slot, and a plurality of serrations. The adjustment panel has a chamber and a guide groove communicating with the chamber. The driven block has a protruded block. The driven block is inserted in the chamber. The spring is disposed between the adjustment panel and the driven block. The cover plate is disposed on the adjustment panel to cover the chamber. The adjustment panel engages with the main plate. The protruded block engages with two of the serrations.

DETAILED DESCRIPTION OF THE INVENTION

Figure 1:
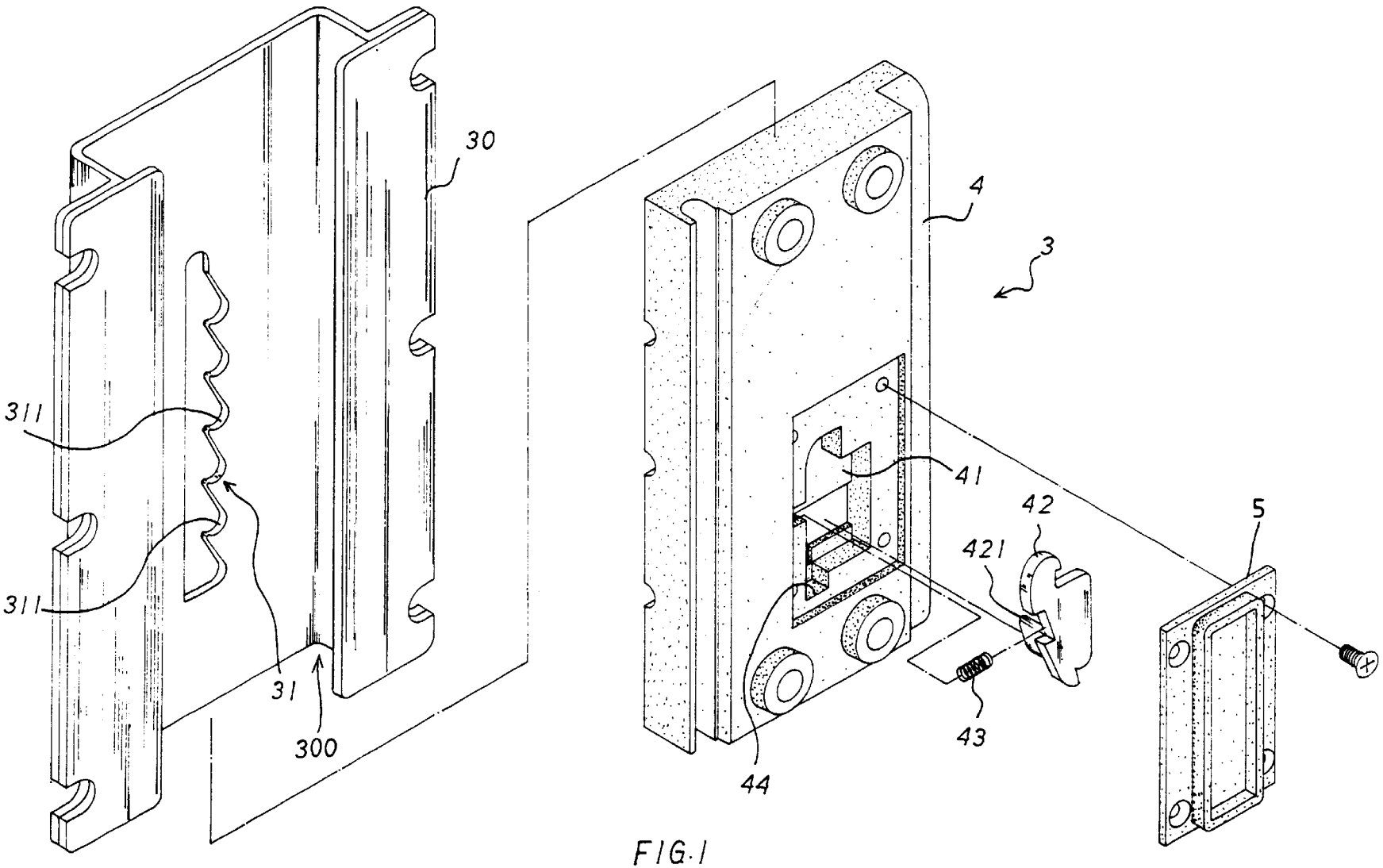
FIG. 1 is a perspective exploded view of a backrest elevator device of a first preferred embodiment in accordance with the present invention.
Figure 2:
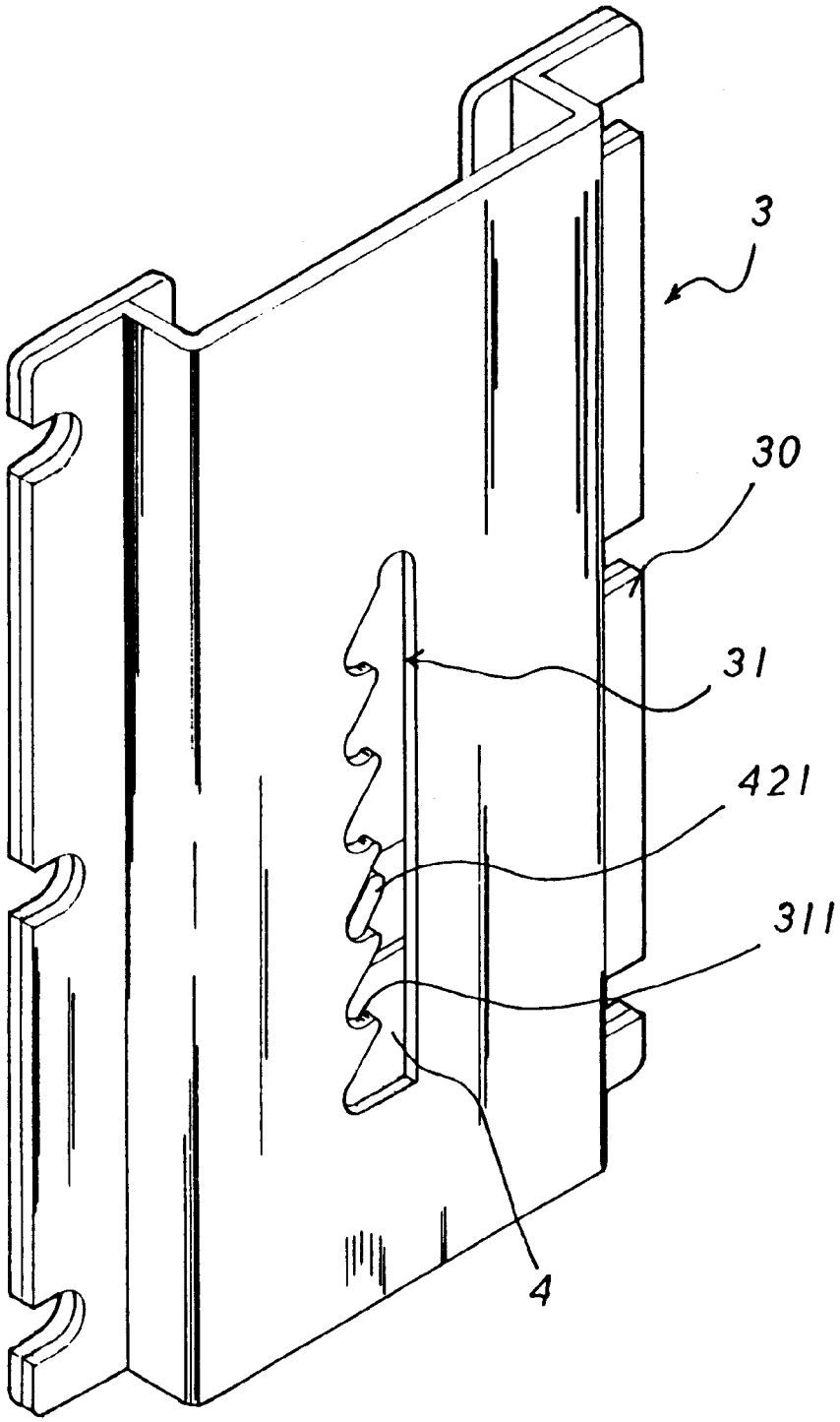
FIG. 2 is a perspective assembly view of a backrest elevator device of a first preferred embodiment in accordance with the present invention.

Referring to FIGS. 1 to 4A, a first backrest elevator device 3 comprises a main plate 30, an adjustment panel 4, a driven block 42, a spring 43, and a cover plate 5.

The main plate 30 has a hollow interior 300, a corrugated slot 31, and a plurality of serrations 311.

The adjustment panel 4 has a chamber 41 and a guide groove 44 communicating with the chamber 41.

The driven block 42 has a protruded block 421.

The driven block 42 is inserted in the chamber 41.

The spring 43 is disposed between the adjustment panel 4 and the driven block 42.

The cover plate 5 is disposed on the adjustment panel 4 to cover the chamber 41.

The adjustment panel 4 engages with the main plate 30.

The protruded block 421 engages with two of the serrations 311.

Referring to FIGS. 3 and 4 again, the driven block 42 engages with the guide groove 44 of the adjustment panel 4.

Figure 3B:
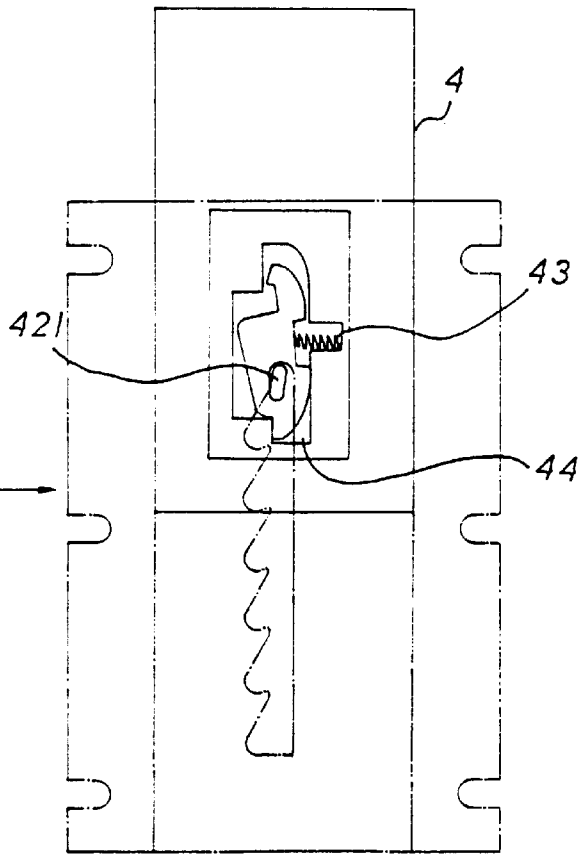
FIG. 3B is a schematic view illustrating a third operation of a backrest elevator device of a first preferred embodiment in accordance with the present invention.
Figure 3A:
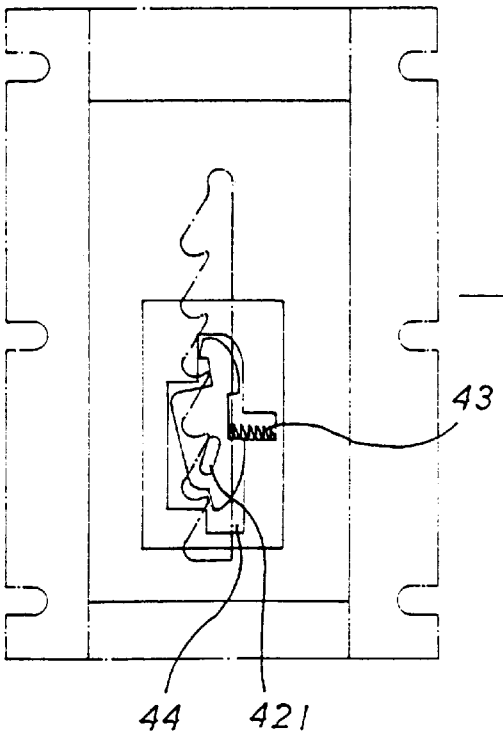
FIG. 3A is a schematic view illustrating a second operation of a backrest elevator device of a first preferred embodiment in accordance with the present invention.
Figure 3:
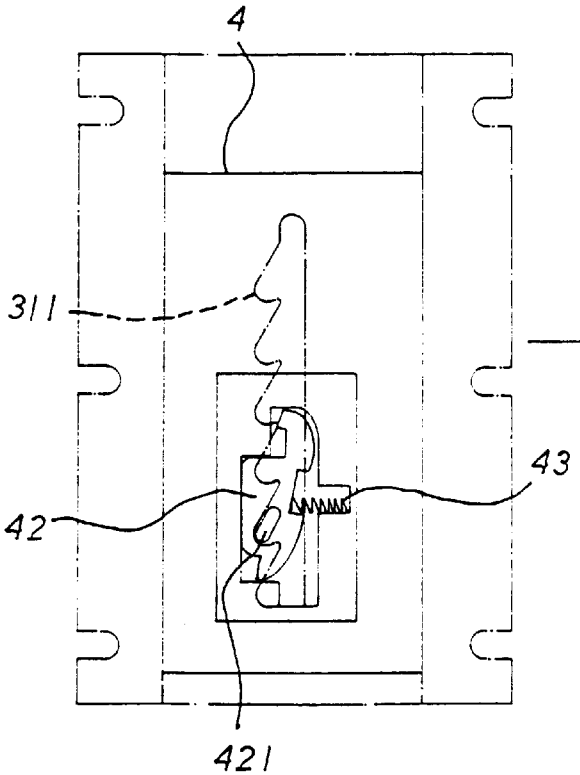
FIG. 3 is a schematic view illustrating a first operation of a backrest elevator device of a first preferred embodiment in accordance with the present invention.
Figure 4A:
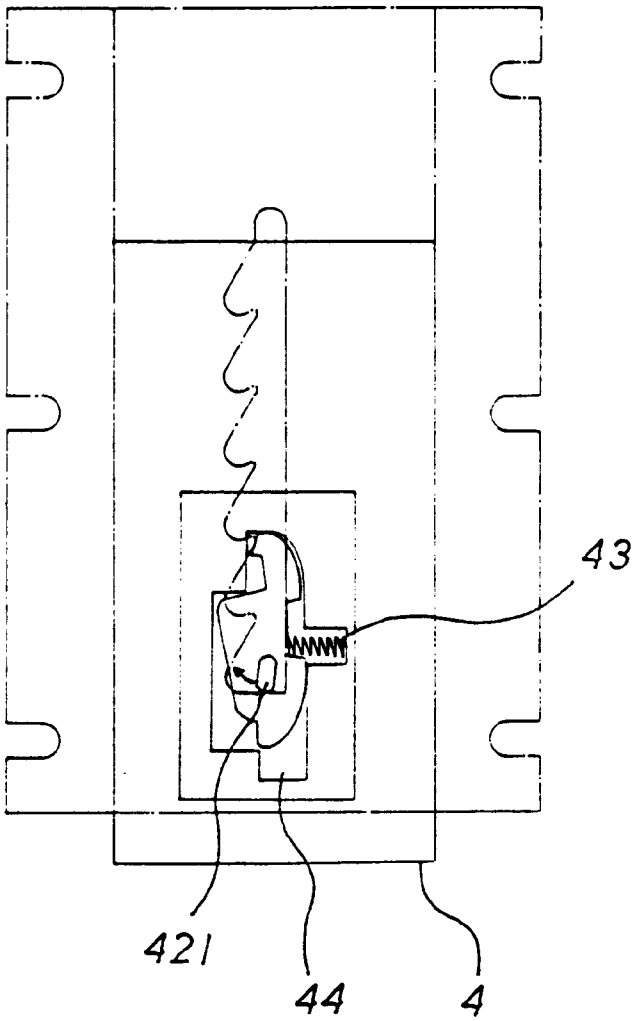
FIG. 4A is a schematic view illustrating a driven block disengaging from a guide groove of an adjustment panel of a first preferred embodiment in accordance with the present invention.
Figure 4:
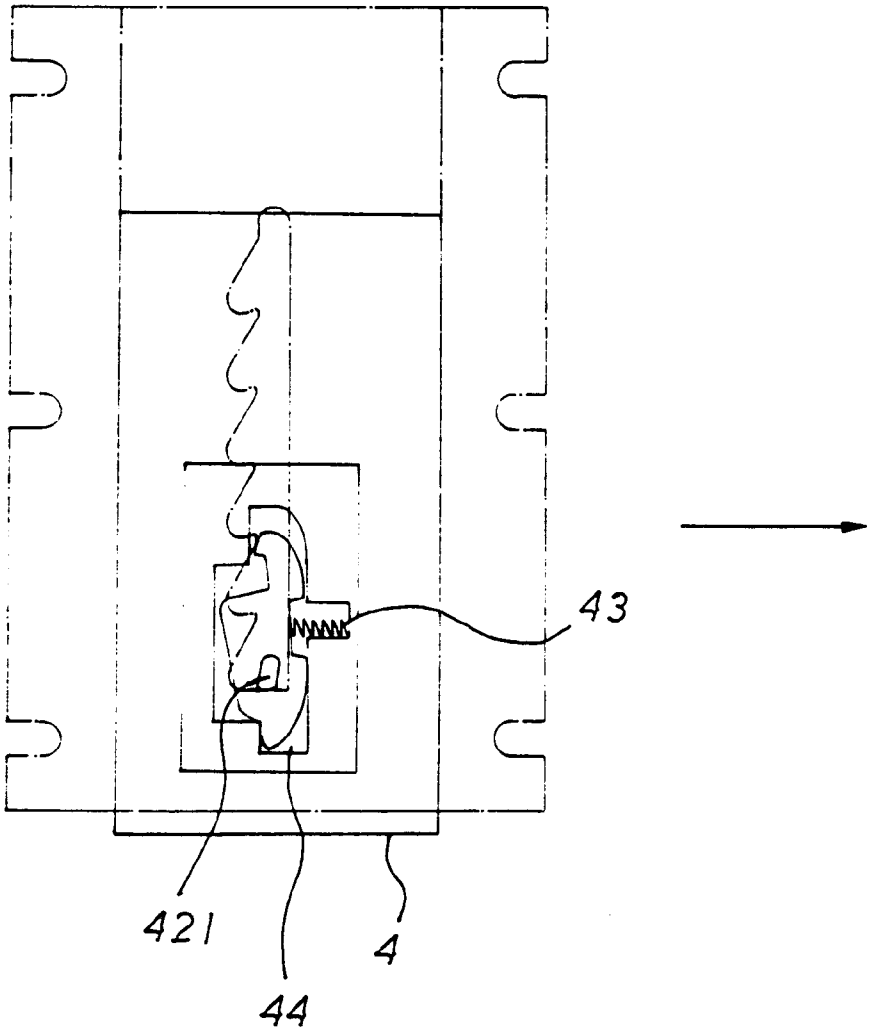
FIG. 4 is a schematic view illustrating a driven block engaging with a guide groove of an adjustment panel of a first preferred embodiment in accordance with the present invention.

Referring to FIGS. 3A and 4A again, the driven block 42 disengages from the guide groove 44 of the adjustment panel 4.

Referring to FIG. 3B again, the adjustment panel 4 is moved upward.

Figure 5:
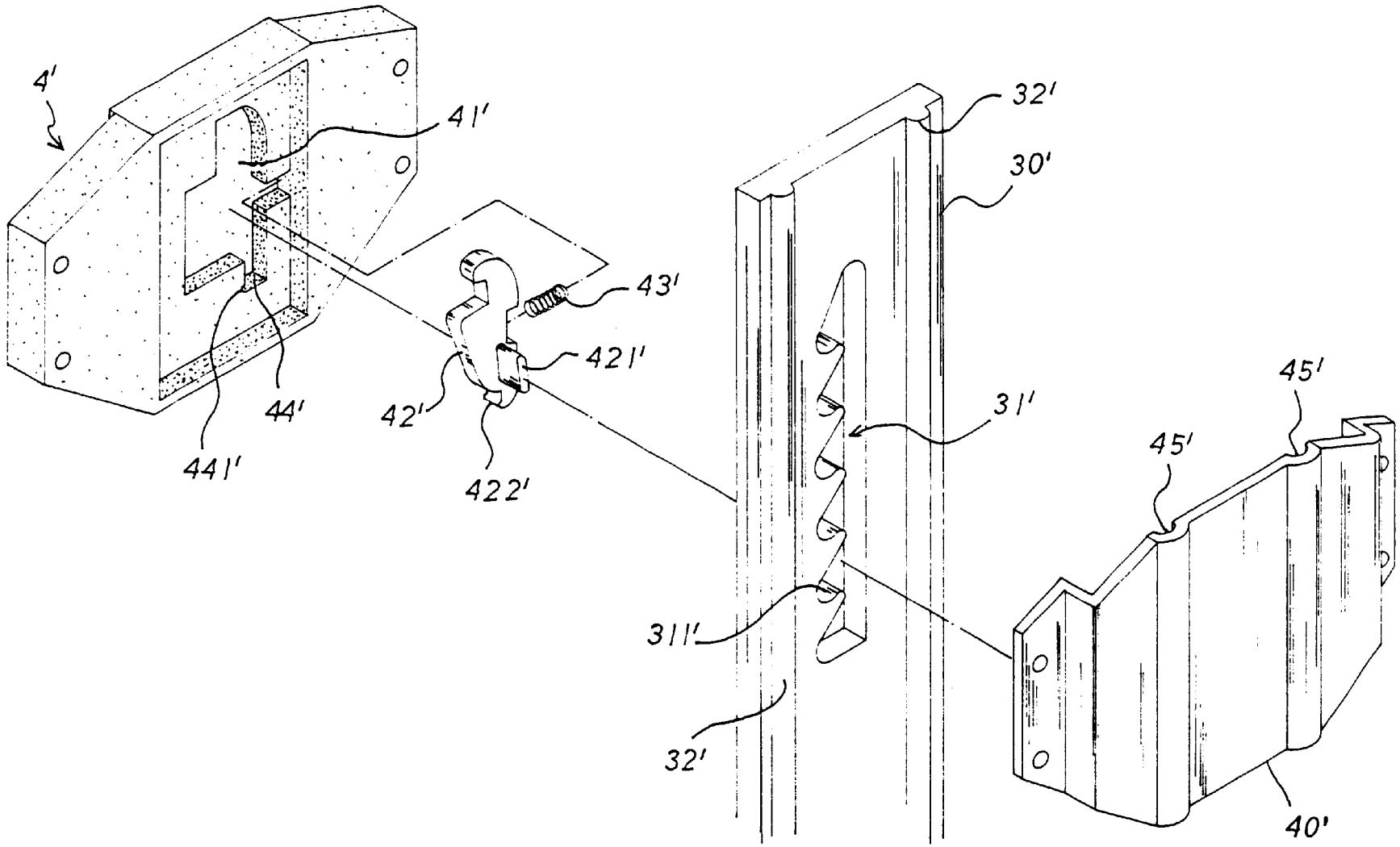
FIG. 5 is a perspective exploded view of a backrest elevator device of a second preferred embodiment in accordance with the present invention.
Figure 6:
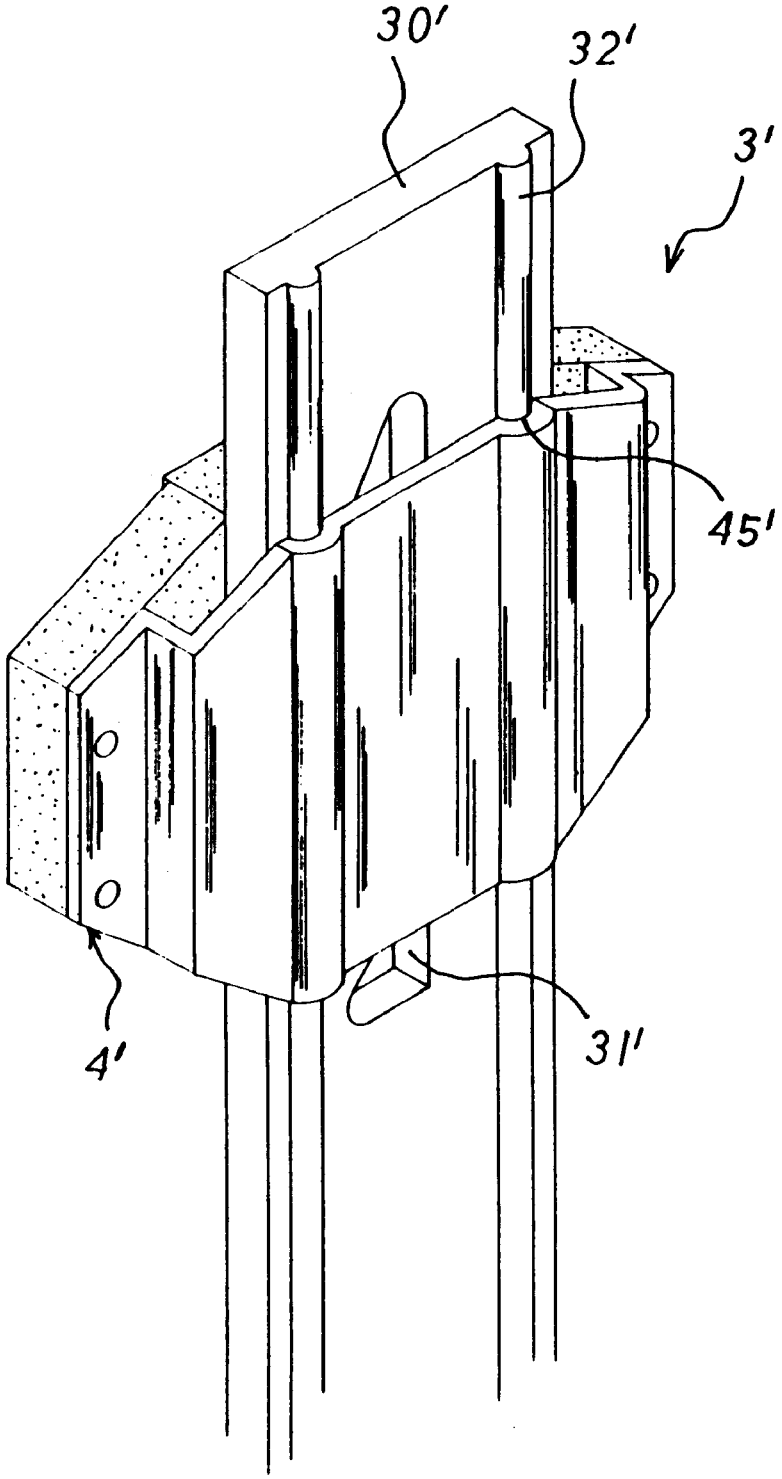
FIG. 6 is a perspective assembly view of a backrest elevator device of a second preferred embodiment in accordance with the present invention.
Figure 7:
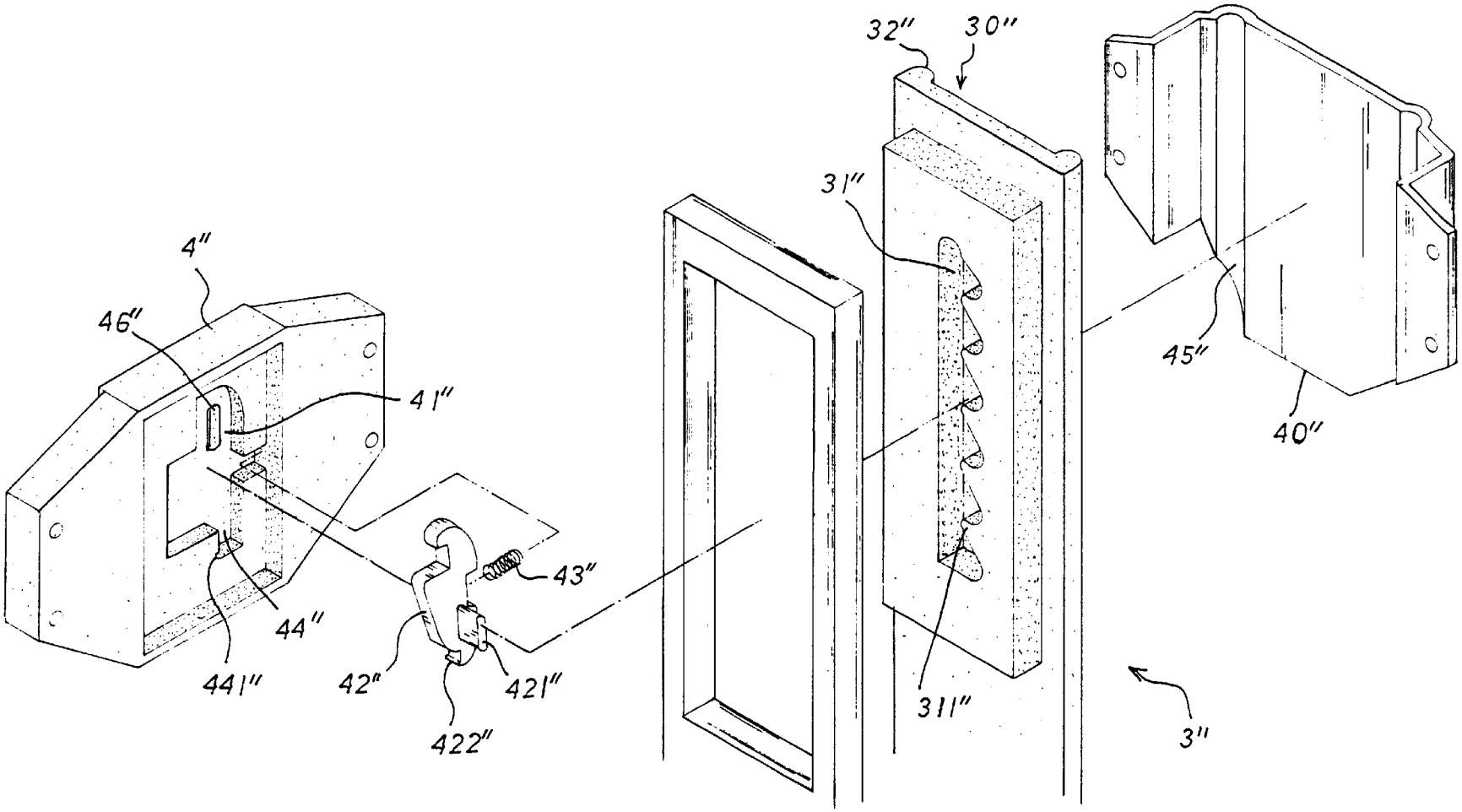
FIG. 7 is a perspective exploded view of a backrest elevator device of a third preferred embodiment in accordance with the present invention.
Figure 8:
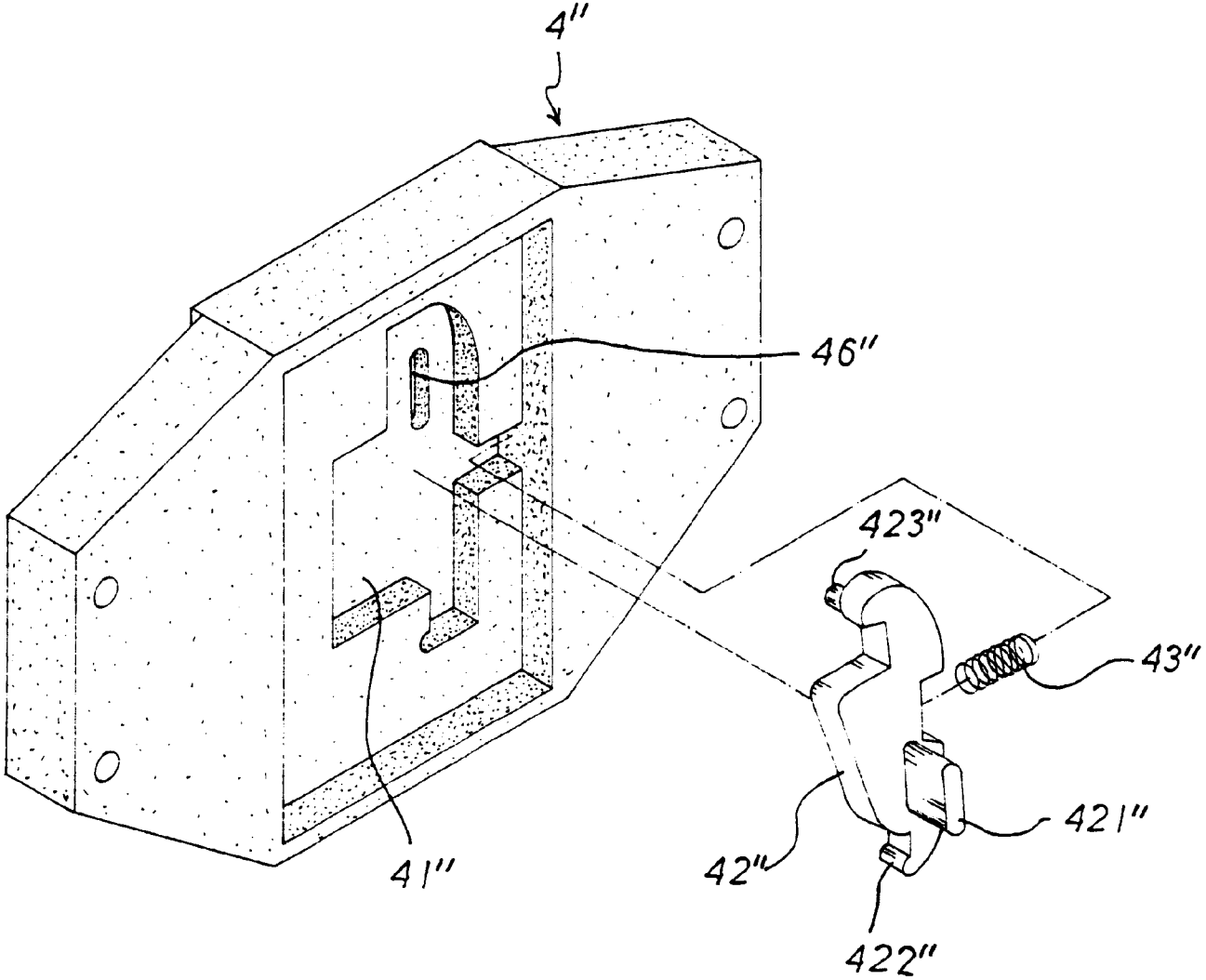
FIG. 8 is a perspective assembly view of a backrest elevator device of a third preferred embodiment in accordance with the present invention.
Figure 9A:
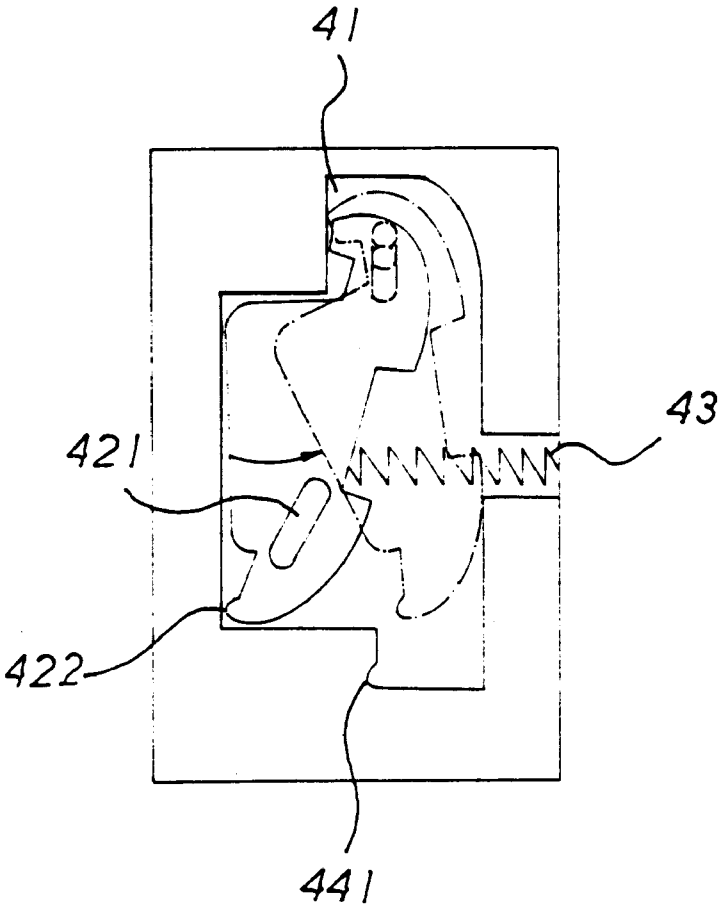
FIG. 9A is a schematic view illustrating a driven block disengaging from a guide groove of an adjustment panel of a third preferred embodiment in accordance with the present invention.
Figure 9:
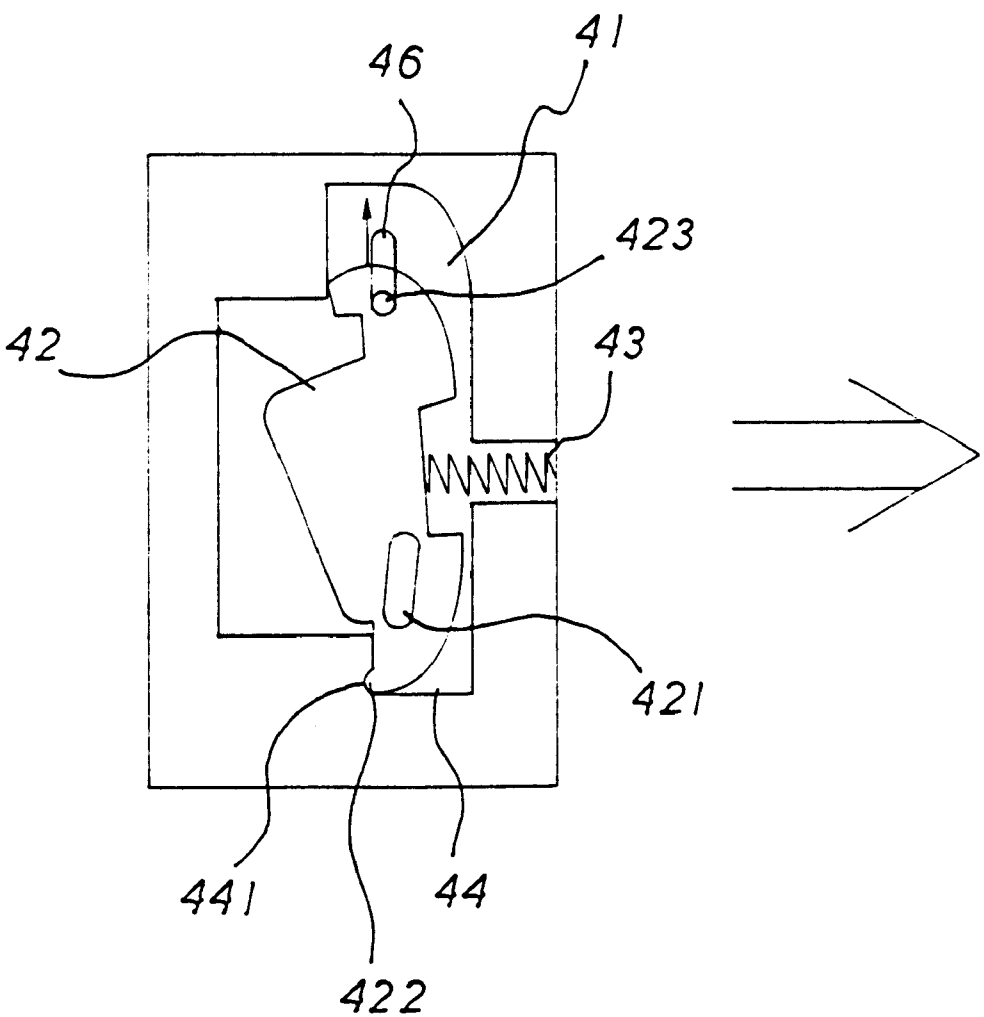
FIG. 9 is a schematic view illustrating a driven block engaging with a guide groove of an adjustment panel of a third preferred embodiment in accordance with the present invention.

Referring to FIGS. 5 and 6, a second backrest elevator device 3' comprises a main plate 30', an adjustment panel 4', a driven block 42', a spring 43', and a cover plate 40'.

The main plate 30' has a corrugated slot 31', a plurality of serrations 311', and two protruded bars 32'.

The adjustment panel 4' has a chamber 41', a guide groove 44' communicating with the chamber 41', and a curved groove 441' communicating with the guide groove 44'.

The driven block 42' has a protruded block 421', and a lower end flange 422'.

The driven block 421 is inserted in the chamber 41'.

The lower end flange 4221 of the driven block 421 is inserted in the curved groove 441' of the adjustment panel 4'.

The spring 43' is disposed between the adjustment panel 4' and the driven block 421.

The cover plate 5' engages with the adjustment panel 4'.

The main plate 30' is disposed between the adjustment panel 4' and the cover plate 5'.

The protruded block 421' engages with two of the serrations 311'.

The cover plate 5' has two channels 45' to receive the protruded bars 32'.

Referring to FIGS. 7 to 9A, a third backrest elevator device 3" comprises a main plate 30", an adjustment panel 4", a driven block 42", a spring 43", and a cover plate 40'.

The main plate 30" has a corrugated slot 31", a plurality of serrations 311", and two protruded bars 32".

The adjustment panel 4" has a chamber 41", a guide groove 44" communicating with the chamber 41", a curved groove 441" communicating with the guide groove 44", and an oblong groove 46".

The driven block 42" has a protruded block 421", a lower end flange 422", and an upper end post 423".

The driven block 42" is inserted in the chamber 41".

The lower end flange 422" of the driven block 42" is inserted in the curved groove 441" of the adjustment panel 4".

The spring 43" is disposed between the adjustment panel 4" and the driven block 42".

The cover plate 5" engages with the adjustment panel 4".

The main plate 30" is disposed between the adjustment panel 4" and the cover plate 5".

The protruded block 421" engages with two of the serrations 311".

The cover plate 5" has two channels 45" to receive the protruded bars 32".

The upper end post 423" is inserted in the oblong groove 46" of the adjustment panel 4".

The invention is not limited to the above embodiment but various modification thereof may be made. Further, various changes in form and detail may be made without departing from the scope of the invention.

I claim:

1. A backrest elevator device comprising;

a main plate, an adjustment panel, a driven block, a spring, and a cover plate, the main plate having a corrugated slot, and a plurality of serrations, the adjustment panel being movably mounted on the main plate and having a chamber and a guide groove communicating with the chamber, the driven block being inserted into the chamber of the adjustment panel and having a protruded block protruded outward from the chamber of the adjustment panel and extended into the corrugated slot of the main plate to engage one of the serrations of the main plate, the driven block being engageable with the guide groove of the adjustment panel, the spring being mounted in the chamber of the adjustment panel and urged between the adjustment panel and the driven block, the cover plate being mounted on the adjustment panel to cover the driven block in the chamber of the adjustment panel, wherein:

the adjustment panel has a curved groove, and the driven block has a protruded lower end flange inserted into the curved groove of the adjustment panel;

the adjustment panel has an oblong groove, and the driven block has an upper end post inserted into the oblong groove of the adjustment panel; and the main plate has two protruded bars, and the cover plate has two channels to receive the protruded bars of the main plate.

* * * * *